US007339566B2

(12) United States Patent
Moh

(10) Patent No.: US 7,339,566 B2
(45) Date of Patent: Mar. 4, 2008

(54) LIQUID CRYSTAL DISPLAY

(75) Inventor: Sang-Moon Moh, Suwon (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 185 days.

(21) Appl. No.: 10/522,387

(22) PCT Filed: Mar. 17, 2003

(86) PCT No.: PCT/KR03/00512

§ 371 (c)(1),
(2), (4) Date: Oct. 11, 2005

(87) PCT Pub. No.: WO2004/011996

PCT Pub. Date: Feb. 5, 2004

(65) Prior Publication Data

US 2006/0125752 A1 Jun. 15, 2006

(30) Foreign Application Priority Data

Jul. 26, 2002 (KR) ..... 10-2002-0044157

(51) Int. Cl.
*G09G 3/36* (2006.01)

(52) U.S. Cl. ..... 345/90; 345/87; 345/96

(58) Field of Classification Search ..... 345/87–90, 345/92, 94, 95–96, 98–100, 204, 209, 210–214; 349/33–34, 37
See application file for complete search history.

(56) References Cited

U.S. PATENT DOCUMENTS 6,310,592 B1 * 10/2001 Moon et al. ..... 345/87
6,392,629 B1 * 5/2002 Murakami et al. ..... 345/98
6,911,962 B1 * 6/2005 Hirakata et al. ..... 345/87

(Continued)

FOREIGN PATENT DOCUMENTS

JP 06-348234 A 12/1994

(Continued)

OTHER PUBLICATIONS

PCT Search Report corresponding to PCT/KR03/00512 filed on Mar. 17, 2003.

(Continued)

*Primary Examiner*—Richard Hjerpe
*Assistant Examiner*—Mansour M. Said
(74) *Attorney, Agent, or Firm*—MacPherson Kwok Chen & Heid LLP

(57) ABSTRACT

A liquid crystal display with multi-line inversion which reverses polarity of applied voltages every two or more rows for preventing the deterioration of liquid crystal. An LCD includes a data driver outputting analog gray voltages selected based on the image data to the data lines of the LC panel. The data driver includes a data line bias circuit biasing the data lines to an intermediate level voltage whenever displaying the pixels in one row. Accordingly, the amount of stored charges between the pixels in the rows with polarity inversion and the pixels in the rows without polarity inversion is reduced, and consequently, the luminance difference between the pixels in the rows with the polarity inversion. The application duration of the data signals for pixels in rows with polarity inversion is also extended, such that the difference in charge storage between the two rows is reduced.

10 Claims, 2 Drawing Sheets

U.S. PATENT DOCUMENTS

| | | | | |
|---|---|---|---|---|
| 7,215,311 | B2 * | 5/2007 | Kim | 345/98 |
| 2003/0071943 | A1 * | 4/2003 | Choo et al. | 349/106 |
| 2006/0139274 | A1 * | 6/2006 | Song et al. | 345/90 |

FOREIGN PATENT DOCUMENTS

| | | | |
|---|---|---|---|
| JP | 11-143435 | A | 5/1999 |
| JP | 2001-235726 | A | 8/2001 |
| JP | 2001-281634 | A | 10/2001 |

OTHER PUBLICATIONS

PCT Prelim Exam, corresponding to PCT/KR03/00512 filed on Mar. 17, 2003.

* cited by examiner

LIQUID CRYSTAL DISPLAY

CROSS-REFERENCE TO RELATED APPLICATION

This application is a national phase application of PCT/KR03/00512 filed on Mar. 17, 2003, and claims priority thereto under 35 USC 371. PCT/KR03/00512, in turn, claims priority from Korean Application No. 10-2002-0044157 filed on Jul. 26, 2002, the content of which is incorporated by reference herein in its entirety.

BACKGROUND OF THE INVENTION (a) Field of the Invention

The present invention relates to a liquid crystal display, and in particular, to a liquid crystal display with multi-line inversion which reverses polarity of applied voltages every two or more rows for preventing the deterioration of liquid crystal. The present invention relates to a liquid crystal display for improving uniformity of image quality of pixels in the rows having reversed polarity.

(b) Description of the Related Art

Recently, displays used for personal computers or TVs are required to be light and slim, and flat panel displays such as liquid crystal displays (LCD) instead of cathode ray tubes are developed and put to practical use for satisfying such a requirement.

The LCD includes a panel including a pixel matrix pattern and another panel opposite thereto. A liquid crystal (LC) having dielectric anisotropy is interposed between the panels. An electric field is generated between the panels. Desired images are displayed by adjusting the field strength to control the transmittance of light passing through the panels.

The LCD receives n-bit red, green, blue (RGB) data from an external graphics source. A timing controller of the LCD data-transforms the RGB data and a data driving integrated circuit (IC) selects gray voltages corresponding to the RGB data. The selected gray voltages are applied to the pixels of the panels to perform display. The gray voltages are DC components. Long-time application of gray voltages with a single polarity to the pixels on the panels deteriorates the liquid crystal in the pixels. This kind of the deterioration of the liquid crystal can be prevented by inversion which reverses the polarity every pixel, every pixel line (or row), or every frame. The present invention relates to an LCD in multi-line inversion, which reverses the polarity of the applied voltages every two or more lines.

FIG. 1 shows waveforms of a data signal and a load signal LOAD in an exemplary multi-line inversion, i.e., a double-line inversion reversing the polarity every two lines.

The data signal shown in FIG. 1 represents display information by its voltage level and is outputted from a data driving IC to be applied to pixels of an LCD panel. The load signal LOAD controls a timing of data signal application from the data driving IC to the LC panels. A duration between two adjacent dotted lines is called a horizontal period (abbreviated as "1H") and the character "N" means that the data signal is applied to the N-th pixel row in the LCD panel. For example, upon receipt of a pulse of the load signal LOAD, the data driving IC of the LCD outputs the data signal to a corresponding data line on the LC panel.

As shown in FIG. 1, the polarity of the data signal applied to the pixel on the LC panel is reversed every two pixel rows with respect to a common voltage Vcom.

The LCD in the multi-line inversion has a problem that the pixels in the rows with reversed polarity are not sufficiently charged. In the example shown in FIG. 1, the amount of charges stored in a pixel in the N-th row are different that stored in a pixels in the (N+1)-th row even if both the pixels represent equal gray level. Since a predetermined transition time for the voltage of the pixel in the N-th row to reach a target level due to the polarity inversion for the N-th row is required, the stored charges in the pixel in the N-th row and the pixel in the (N+1)-th row is different. The difference in the stored charges causes the difference in the luminance, thereby deteriorating display characteristics. For example, the pixel in the N-th row experiencing the polarity inversion is brighter than the pixel in the (N+1)-th row, which has an equal gray level, for a normally white mode LCD since the amount of the stored charges in the pixels of the N-th row is smaller than that the pixel of the (N+1)-th row. As a result, an LCD with the conventional multi-line inversion has a problem of luminance difference between the pixels in the rows experiencing the polarity inversion and the pixels in the other rows.

SUMMARY OF THE INVENTION

A motivation of the present invention is to solve the problem of the conventional art under the technical background and to provide a liquid crystal display and driving method thereof with multi-line inversion capable of reducing the luminance variation of the pixels between the rows with the polarity inversion and the other rows.

A liquid crystal display is provided, which includes: a liquid crystal panel including a plurality of gate lines, a plurality of data lines intersecting the gate lines, and a plurality of pixels provided near the intersections of the gate lines and the data lines; a timing controller receiving image data and synchronization signals from an external graphics source, performing format conversion for the image data and generating control signals required for driving the liquid crystal panel; a voltage generator generating gray voltages and gate voltages required for the liquid crystal panel; a gate driver sequentially scanning the gate lines of the liquid crystal panel by unit of one horizontal canning period based on the gate voltages; and a data driver arranges the image data from the timing controller corresponding to the data lines of the liquid crystal panel, selecting the gray voltages corresponding to the image data, and applying the select ed voltages the pixels connected to the scanned the gate lines through the data lines, wherein the data driver reverses the polarity of the gray voltages to be applied to the data lines of the liquid crystal panel by a predetermined number of rows, and biases the data lines to a voltage with a predetermined level before outputting the gray voltages to the pixels in each scanned row.

The data driver of the liquid crystal display biases the data lines to an intermediate level voltage whenever displaying the pixels in one row such that the amount of stored charges between the pixels in the rows with polarity inversion and the pixels in the rows without polarity inversion is reduced, and consequently, the luminance difference between the pixels in the rows with the polarity inversion. In addition, the present invention elongates the application duration of the data signals for the pixels in the rows with the polarity inversion compared with the application duration of the data signals for the pixels in the rows without the polarity inversion such that the difference in the charge storage between the two rows is reduced.

BRIEF DESCRIPTION OF THE DRAWINGS

The advantages of the present invention will become more apparent by describing preferred embodiments thereof in detail with reference to the accompanying drawings in which.

DESCRIPTION OF REFERENCE NUMERALS INDICATING PRIMARY ELEMENTS IN THE DRAWINGS

| | |
|---|---|
| 10: LC panel | 20: gate driver |
| 30: data driver | 40: voltage generator |
| 50: timing controller | 31: shift register |
| 32: D/A converter | 33: latch |
| 34: data line bias circuit | |

DETAILED DESCRIPTION OF PREFERRED EMBODIMENTS

The present invention now will be described more fully hereinafter with reference to the accompanying drawings, in which preferred embodiments of the inventions are shown. The present invention may, however, be embodied in many different forms and should not be construed as limited to the embodiments set forth herein.

Now, LCDs and driving methods thereof according to an embodiment of the present invention are described in detail with reference to the accompanying drawings.

Figure 1:
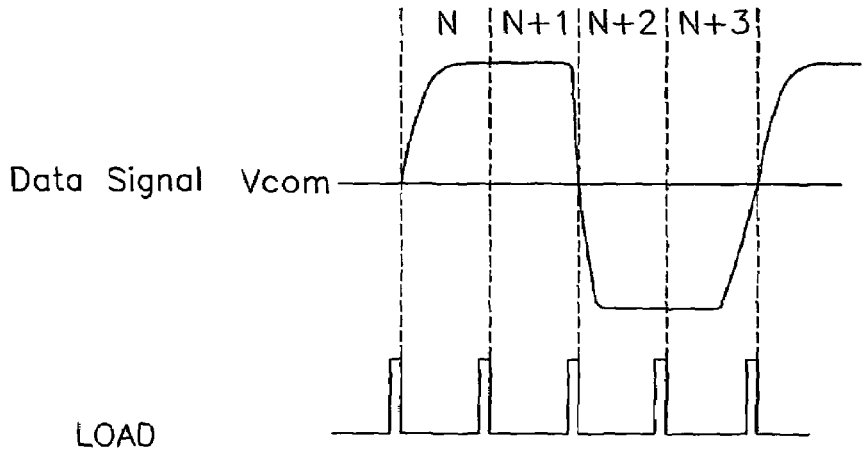
FIG. 1 shows waveforms of a data signal and a load signal LOAD in a conventional double-line inversion.
Figure 2:
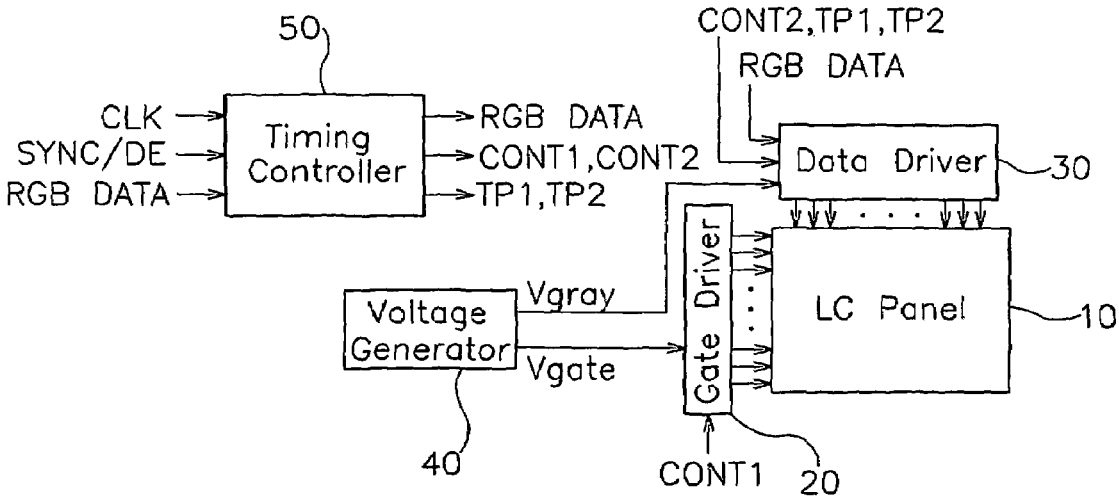
FIG. 2 is a block diagram of an LCD according to an embodiment of the present invention.
Figure 3:
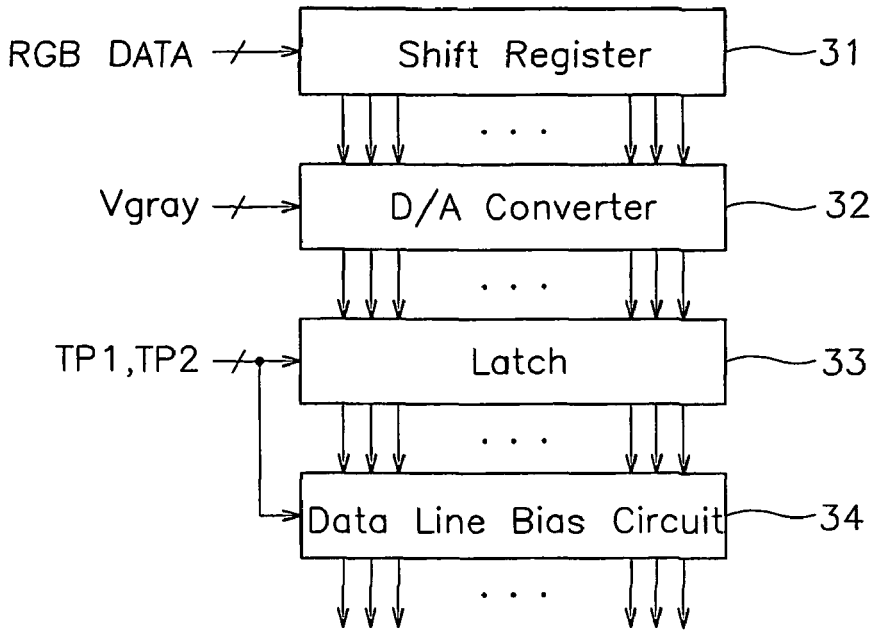
FIG. 3 is an exemplary block diagram of a data driver shown in FIG. 2.

FIG. 2 is a block diagram of an LCD according to an embodiment of the present invention and FIG. 3 is an exemplary block diagram of a data driver shown in FIG. 2.

Referring to FIG. 2, an LCD according to an embodiment of the present invention includes an LC panel 10, a gate driver 20, a data driver 30, a voltage generator 40, and a timing controller 50.

The LC panel 10 includes, although it is not shown in the figure, a plurality of gate lines, a plurality of gate lines, a plurality of data lines crossing the gate lines, and a plurality of pixels provided near intersections of the data lines and the data lines and arranged in matrix. Each pixel includes a thin film transistor (TFT) having a gate electrode connected to one of the gate lines, a source electrode connected to one of the data lines, and a drain electrode, and a pixel capacitor and a storage capacitor connected to the drain electrode of the TFT. The TFTs turns on in response to a gate signal for selecting relevant one of the gate lines from the gate driver 20. The data driver 30 applies data voltages representing display information to the data lines. The data voltages are applied to the pixel capacitors and the storage capacitors of the pixels through the TFTs to driver the capacitors, thereby performing display operations.

The timing controller 50 receives RGB data (RGB DATA), synchronization signals SYNC, a data enable signal DE, and a clock signal CLK from an external graphics source (not shown). The timing controller 50 converts format of the RGB data RGB DATA suitable for a standard required for the data driver 30 and generates and outputs control signals CONT1 and CONT2 to be used by the gate driver 20 와the data driver 30 for driving the LC panel 10 based on the synchronization signals (SYNC), the data enable signal DE and the dock signal CLK. In addition, the timing controller 50 generates a pair of load signals TP1 and TP2 for controlling a timing of the application of the data voltages from the data driver 30 to the pixels on the LC panel 10 and outputs the load signals TP1 and TP2 to the data driver 30.

The voltage generator 40 generates and outputs gray voltages Vgray to be applied to the data lines of the LC panel 10 and a pair of gate voltages Vgate to be applied to the gate lines of the LC panel 10. The gray voltages Vgray have a plurality of voltage levels and are transmitted to the data driver 30. The gate voltages Vgate includes a gate-on voltage and a gate-off voltage and are transmitted to the gate driver 20.

The gate driver 20 includes a plurality of the gate driving ICs respectively taking charge of a predetermined number of the gate lines of the LC panel 10. The gate driver 20 sequentially scans the gate lines of the LCD panel 10 by unit of a horizontal scanning period based on the control signals CONT1 from timing controller 50 and the gate voltages Vgate from the voltage generator 40. For example, the gate driver 20 applied the gate-on voltage to a gate line to be scanned for one horizontal scanning period and applied the gate-off voltage to the remaining gate lines. The above-described scanning is sequentially performed to all gate lines.

The data driver 30 includes a plurality of data driving IC respectively taking charge of a predetermined number of the data lines of the LC panel 10. An exemplary configuration of each data driving IC is illustrated in FIG. 3, which will be described later in detail. The data driver 30 shifts the serially inputted RGB data (RGB DATA) supplied from the timing controller 50 to be arranged corresponding to the respective data lines, and thereafter, it selects appropriate gray voltages Vgray for the RGB data and applied the selected gray voltages the data lines of the LC panel 10 as the data signals. The data arrangement, the gray voltage selection, and the voltage application to the LC panel are repeated to all row of the LC panel.

In the meantime, the present invention suggests two solutions for insufficient charging of the pixels in the rows experiencing the polarity inversion when the gray voltages are applied to the data lines.

A solution biases the data signals for a pixel row of the LCD panel 10 to a voltage with a predetermined level when the data signals for the pixel row are outputted after the data signals for a previous pixel row is outputted from the data driver 30. This solution equalizes the charges in all the data lines of the LC panel 10 and is called charge sharing. That is, after the pixels in a row experiencing the polarity inversion are supplied with the data signals, the voltages of all the data lines on the LC panel are converted into an intermediates level and then the data lines are supplied with the data signals when the pixels in a row without the polarity inversion are supplied with the data signals. Accordingly, the voltage of each pixel without the polarity inversion requires a transition time for the intermediate level to a target level, and hence the difference in charging voltage levels between the pixels in the rows with the polarity inversion and the pixels in the rows without the polarity inversion can be reduced. Although the present invention exemplifies a ground level as the predetermined intermediate level, the scope of the present invention is not limited hereto. It is apparent that an ordinary skill in the art differentiates the intermediates levels for different polarity, for example, a positive intermediate voltage and a negative intermediate voltage are used for biasing the data lines.

The other solution differentiates the application durations of the data signals for the rows with the polarity inversion and for the rows without the polarity inversion. In detail, the application duration of the data signals for the pixels in the rows with the polarity inversion are elongated since the pixels in the rows with the polarity inversion are less charged than the pixels in the rows without the polarity inversion. It is obtained by controlling the timing of the load signal used in the data driver 30. In detail, the pulse intervals of the load signal are set so that the application duration of the data signals for the pixels in the rows with the polarity inversion (referred to as a first application duration hereinafter) are longer than the application duration of the data signals for the pixels in the rows without the polarity inversion (referred to as a first application duration hereinafter).

Figure 4:
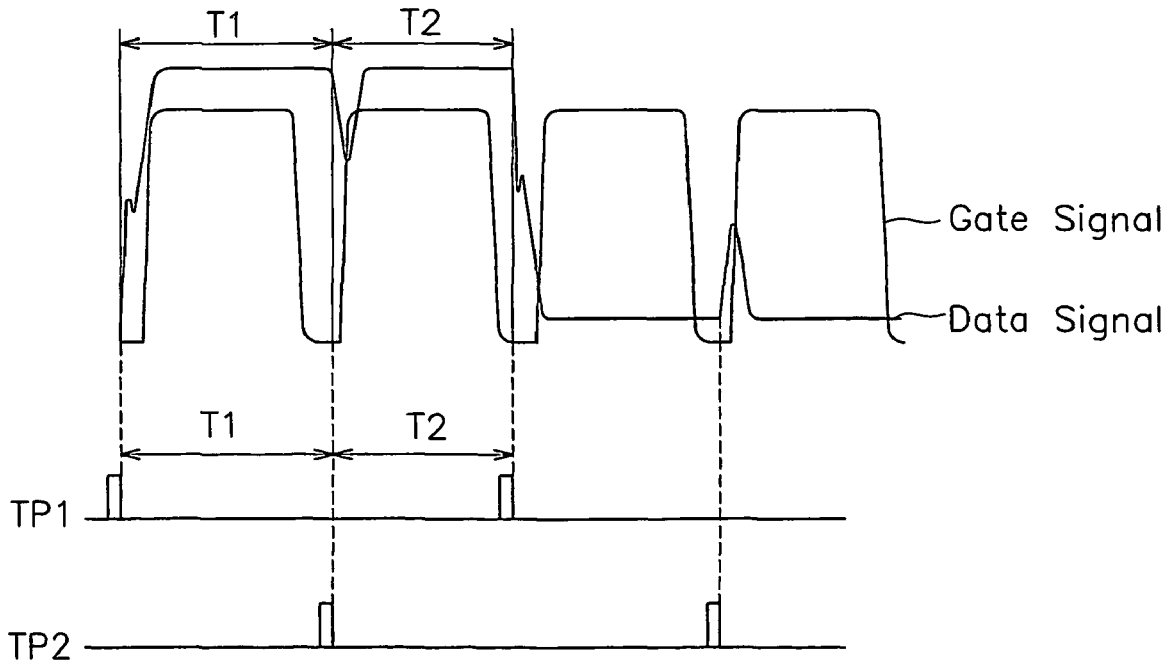
FIG. 4 illustrates waveforms of signals used for the data driver shown in FIG. 3.

An LCD according to an embodiment of the present invention is described in more detail with reference to FIGS. 3 and 4.

A block diagram shown in FIG. 3 shows an exemplary detailed configuration of a data driving IC of the data driver 30 shown in FIG. 2.

Each data driving IC of the data driver 30 includes a shift register 31, a digital-to-analog (D/A) converter 32, a latch 33, and the data line bias circuit 34. Each data driving IC is assigned to a predetermined number of the data lines of the LC panel 10.

The shift register 31 shifts in bits the RGB data from the timing controller 50 and arranges the RGB data corresponding to the assigned data lines of the data driving IC. The D/A converter 32 digital-to-analog converts the RGB data by selecting analog gray voltages Vgray in accordance with the digital RGB data aligned with the data lines. The latch 33 outputs the gray voltages selected for the respective data lines to the LC panel 10 in response to the load signals TP1 and TP2. Referring to FIG. 4, upon the generation of pulses of the load signals TP1 and TP2, a row in the LC panel 10 to be displayed are selected by a gate signal and the data signals are outputted from the data driving IC to the LC panel 10 such that the pixels in the selected row are written with the data signals. The timing controller 50 controls the pulse generation timing of the load signals TP1 and TP2 such that a duration T1 for the application of the data signals to the pixels in the rows with the polarity inversion is longer than a duration T2 for the application of the data signals to the pixels in the rows without the polarity inversion. The data line bias circuit 34 biases the data lines assigned to the data driving IC into a ground potential upon every generation of the load signals TP1 and TP2. In an example shown in FIG. 4, after the pixels in a row with the polarity inversion are supplied with positive data signals, and then the data signals are temporarily dropped down to an intermediate level and then start rising when the target is changed into the next row. On the contrary, the negative data signals are temporarily increased to the intermediate level and then fall again. In this way, the pixels in the rows with the polarity inversion have increased charging time while the pixels in the rows without the polarity inversion have decreased charging time. Accordingly, the difference in the charging time between the rows with the polarity inversion and the pixels in the rows without the polarity inversion is reduced to improve the luminance difference in the conventional art.

As described above, although the embodiments of the present invention illustrate the double-line inversion, the scope of the present invention includes any multi-line inversion.

As described above, a data driver of an LCD in multi-line inversion biases the data lines into an intermediate level whenever the pixels of every line are subject to display such that the difference in the charge storage between the pixels in the rows with the polarity inversion and the pixels in the rows without the polarity inversion, and accordingly, the luminance difference between the pixels in the rows with the polarity inversion. In addition, the LCD according to an embodiment of the present invention elongates the application duration of the data signals for the pixels in the rows with the polarity inversion compared with that for the pixels in the rows without the polarity inversion such that the difference in the charge storages between the two lines is reduced.

Although preferred embodiments of the present invention have been described in detail hereinabove, it should be dearly understood that many variations and/or modifications of the basic inventive concepts herein taught which may appear to those skilled in the present art will still fall within the spirit and scope of the present invention, as defined in the appended claims.

What is claimed is:

1. A liquid crystal display, comprising:

a liquid crystal panel including a plurality of gate lines, a plurality of data lines intersecting the gate lines, and a plurality of pixels provided near the intersections of the gate lines and the data lines;

a timing controller receiving image data and synchronization signals from an external graphics source, performing format conversion for the image data and generating control signals required for driving the liquid crystal panel;

a voltage generator generating gray voltages and gate voltages required for the liquid crystal panel;

a gate driver sequentially scanning the gate lines of the liquid crystal panel by unit of one horizontal scanning period based on the gate voltages; and a data driver arranges the image data from the timing controller corresponding to the data lines of the liquid crystal panel, selecting the gray voltages corresponding to the image data, and applying the selected voltages the pixels connected to the scanned the gate lines through the data lines, wherein the data driver reverses the polarity of the gray voltages to be applied to the data lines of the liquid crystal panel by a predetermined number of rows, and biases the data lines to a voltage with a predetermined level before outputting the gray voltages to the pixels in each scanned row.

2. The liquid crystal display of claim 1, wherein the data driver is controlled such that a duration for applying the gray voltages to the pixels in the rows with polarity inversion is longer than a duration for applying the gray voltages to the pixels in the rows without polarity inversion.

3. The liquid crystal display of claim 2, wherein the data driver comprises a plurality of data driving ICs, each data driving IC assigned to a predetermined number of the data lines of the liquid crystal panel, and each of the data driving ICs comprises, a shift register shifting the image data from the timing controller and arranging the image data corresponding to the data lines;

a digital-to-analog converter selecting analog gray voltages corresponding to the image data for the data lines;

a latch outputting the gray voltages selected by the digital-to-analog converter to the liquid crystal panel in response to a predetermined control signal; and data line bias circuit biasing the data lines of the liquid crystal panel to the voltage with the predetermined level whenever the latch outputs the gray voltages to the liquid crystal panel.

4. The liquid crystal display of claim 3, wherein the voltage with the predetermined level includes a ground voltage.

5. The liquid crystal display of claim 3, wherein the voltage with the predetermined level for positive polarity is different from the voltage with the predetermined level for negative polarity.

6. The liquid crystal display of claim 3, wherein the predetermined control signal comprises a load signal controlling a timing for applying the gray voltages from the data driver to the data lines of the liquid crystal panel and a pulse timing of the load signal is determined by the timing controller.

7. The liquid crystal display of claim 1, wherein the data driver comprises a plurality of data driving ICs, each data driving IC assigned to a predetermined number of the data lines of the liquid crystal panel, and each of the data driving ICs comprises, a shift register shifting the image data from the timing controller and arranging the image data corresponding to the data lines;

a digital-to-analog converter selecting analog gray voltages corresponding to the image data for the data lines;

a latch outputting the gray voltages selected by the digital-to-analog converter to the liquid crystal panel in response to a predetermined control signal; and data line bias circuit biasing the data lines of the liquid crystal panel to the voltage with the predetermined level whenever the latch outputs the gray voltages to the liquid crystal panel.

8. The liquid crystal display of claim 7, wherein the voltage with the predetermined level includes a ground voltage.

9. The liquid crystal display of claim 7, wherein the voltage with the predetermined level for positive polarity is different from the voltage with the predetermined level for negative polarity.

10. The liquid crystal display of claim 7, wherein the predetermined control signal comprises a load signal controlling a timing for applying the gray voltages from the data driver to the data lines of the liquid crystal panel and a pulse timing of the load signal is determined by the timing controller.

* * * * *